US006269231B1

(12) United States Patent
Castelli et al.

(10) Patent No.: US 6,269,231 B1
(45) Date of Patent: Jul. 31, 2001

(54) BELT TENSION VARIATION MINIMIZING MECHANISM AND A REPRODUCTION MACHINE HAVING SAME

(75) Inventors: Vittorio R. Castelli, Yorktown Heights, NY (US); Osman T. Polatkan, North Haledon, NJ (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/560,516

(22) Filed: Apr. 28, 2000

(51) Int. Cl.[7] ..... G03G 15/00
(52) U.S. Cl. ..... 399/165; 198/813; 474/101
(58) Field of Search ..... 399/162–165, 399/303, 313; 198/808, 813, 814; 474/101, 111, 112, 133, 135, 136, 138

(56) References Cited

U.S. PATENT DOCUMENTS 5,585,892 * 12/1996 Hayano et al. ..... 399/164
5,991,575 * 11/1999 Okiyama et al. ..... 399/165
6,055,398 * 4/2000 Costanza et al. ..... 399/165
6,085,053 * 7/2000 Saeki ..... 399/165
6,101,353 * 8/2000 Yu et al. ..... 399/165
6,137,974 * 10/2000 Williams et al. ..... 399/165

* cited by examiner

*Primary Examiner*—William J. Royer
(74) *Attorney, Agent, or Firm*—Tallam I. Nguti

(57) ABSTRACT

A tensioning mechanism is provided for minimizing tension variations in a moveable endless belt having a desired tension setting and includes a moveable member for mounting transversely to a direction of movement of the moveable endless belt and into contact with the moveable endless belt; a first assembly including a first rotatable arm having a first end connected to the moveable member, and a second end coupled to a first pivot; and a second assembly including a tensioning force applying roller, and a second rotatable arm having a first end connected to the moveable member and a second end coupled to a second pivot. The second rotatable arm forms a lap angle with the first rotatable arm, and the tensioning force applying roller applies a tensioning force to the moveable member having a force direction that is non-orthogonal relative to the direction of movement of the moveable endless belt, thereby tensioning the moveable endless belt and minimizing variations from the desired tension setting of the moveable endless belt.

15 Claims, 5 Drawing Sheets

BELT TENSION VARIATION MINIMIZING MECHANISM AND A REPRODUCTION MACHINE HAVING SAME

FIELD OF THE INVENTION

This invention relates to belt tension variation minimizing mechanisms, and more particularly to an electrostatographic reproduction machine having the same for an economical and effective tensioning of closed loop or endless belt components, such as a photoreceptor belt or intermediate transfer belt of the reproduction machine.

BACKGROUND OF THE INVENTION

Electrostatographic marking is a well known and commonly used method of copying or printing documents. Electrostatographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image. The foregoing broadly describes a conventional black and white electrostatographic reproduction machine.

Electrostatographic marking can also produce color images by repeating the above process once for each color of toner that is used to make the composite color image. This can be accomplished using any one of a number of different IOI (image-on-image) processes including, for example, what is referred to as Tandem Xerography, or what is referred to as the REaD (Recharge, Expose, and Develop, Image On Image).

In the Tandem Xerographic process, a plurality of different color toner image forming Xerographic modules each form a color separation toner image of a multicolor original image, and then transfer such color separation images in registration onto an intermediate transfer belt (ITB), for example.

In the REaD process, a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed on the photoreceptor in superimposed registration so that a desired composite color image results. That composite color image is then transferred and fused onto a substrate.

The REaD process as such can be implemented in a single pass reproduction machine wherein the composite final image is produced in a single pass of the photoreceptor through the machine. It can also be implemented in a multiple pass, for example four passes, of the photoreceptor, wherein only one color toner image is produced during each pass of the photoreceptor through the machine and wherein the composite color image is transferred and fused during the fourth pass.

In an electrostatographic reproduction machine employing any of the processes described above, the endless photoreceptor when a belt, or the endless intermediate transfer belt (ITB), is initially tensioned and set to a tension setting as desired, but ordinarily will experience variations from each such desired tension setting. As can be expected, such variations in the tension are likely to cause registration errors, and may even lead to slack in the belt, and thus adversely affect the life of the belt.

Conventional tensioning mechanisms use a tensioning roller to apply a force in the direction of the bisectrix to the angle of wrap of the belt. The force is conventionally applied by a compressed loading spring. Variations from a desired tension setting are ordinarily caused by movement of the tensioning roller due to two problems, namely: (a) the finite stiffness of the loading spring, and (b) changes in wrap angle of the belt over the tensioning roller. The first problem is counteracted by one current technology method, which generates the force without an associated stiffness; this is accomplished by using either a dead weight or an electromagnetic loading device. These measures do not counteract tension variations due to the second problem.

Another possible technology is to provide the tensioning by means of an active servo whereby the force decreases appropriately as the tensioning roller moves outward. This is an effective technology solution to the problem but it has the disadvantage of raising cost issues.

It should be recognized that the second problem becomes more serious in designs where the angle of wrap on the tensioning roller is relatively small, which is typically the case in small machines such as office reproduction machines.

There is therefore a need for a belt tension variation minimizing mechanism, and for an electrostatographic reproduction machine having the same so as to provide economical and effective tensioning of closed loop or endless belt components, such as a photoreceptor belt or intermediate transfer belt of the reproduction machine.

SUMMARY OF THE INVENTION

In accordance to the present invention, there is provided a tensioning mechanism for minimizing tension variations in a moveable endless belt having a desired tension setting and includes a moveable member for mounting transversely to a direction of movement of the moveable endless belt and into contact with the moveable endless belt; a first assembly including a first rotatable arm having a first end connected to the moveable member, and a second end coupled to a first pivot; and a second assembly including a tensioning force applying roller, and a second rotatable arm having a first end connected to the moveable member and a second end coupled to a second pivot. The second rotatable arm forms a lap angle with the first rotatable arm, and the tensioning force applying roller applies a tensioning force to the moveable member having a force direction that is non-orthogonal relative to the direction of movement of the moveable endless belt, thereby tensioning the moveable endless belt and minimizing variations from the desired tension setting of the moveable endless belt.

BRIEF DESCRIPTION OF THE DRAWINGS

In the detailed description of the invention presented below, reference is ma to the drawings, in which.

DETAILED DESCRIPTION OF THE INVENTION

While the present invention will be described in connection with a particular embodiment thereof, it will be understood that it is not intended to limit the invention to that embodiment only. On the contrary, it is intended to cover all alternatives, modifications, and equivalents as may be included within the spirit and scope of the invention as defined by the appended claims.

Figure 1:
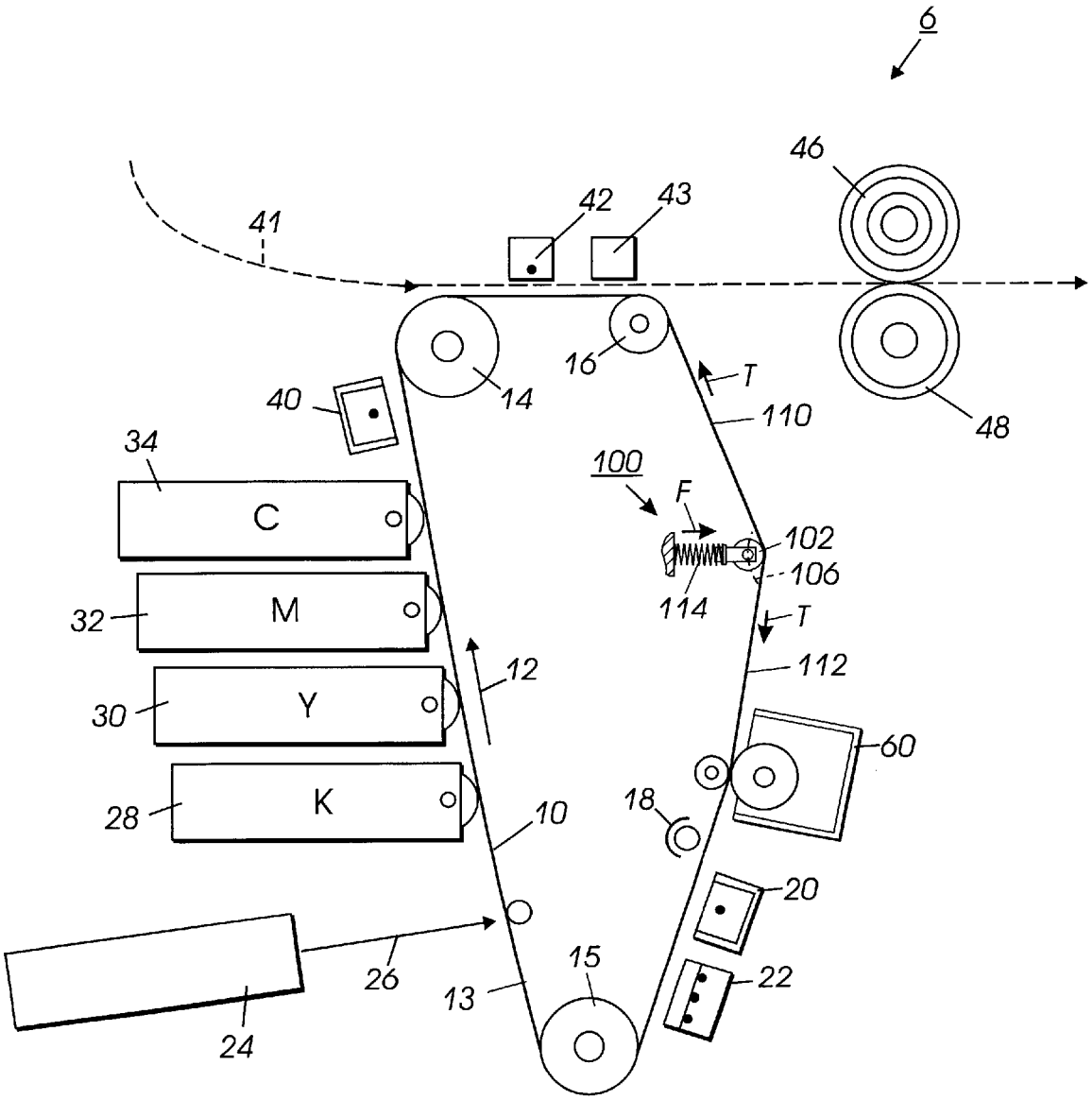
FIG. 1 PRIOR ART
FIG. 1 is a vertical schematic of an exemplary electrostatographic reproduction machine including a typical prior art tensioning mechanism in the form of a eteoning roller.
Figure 2:
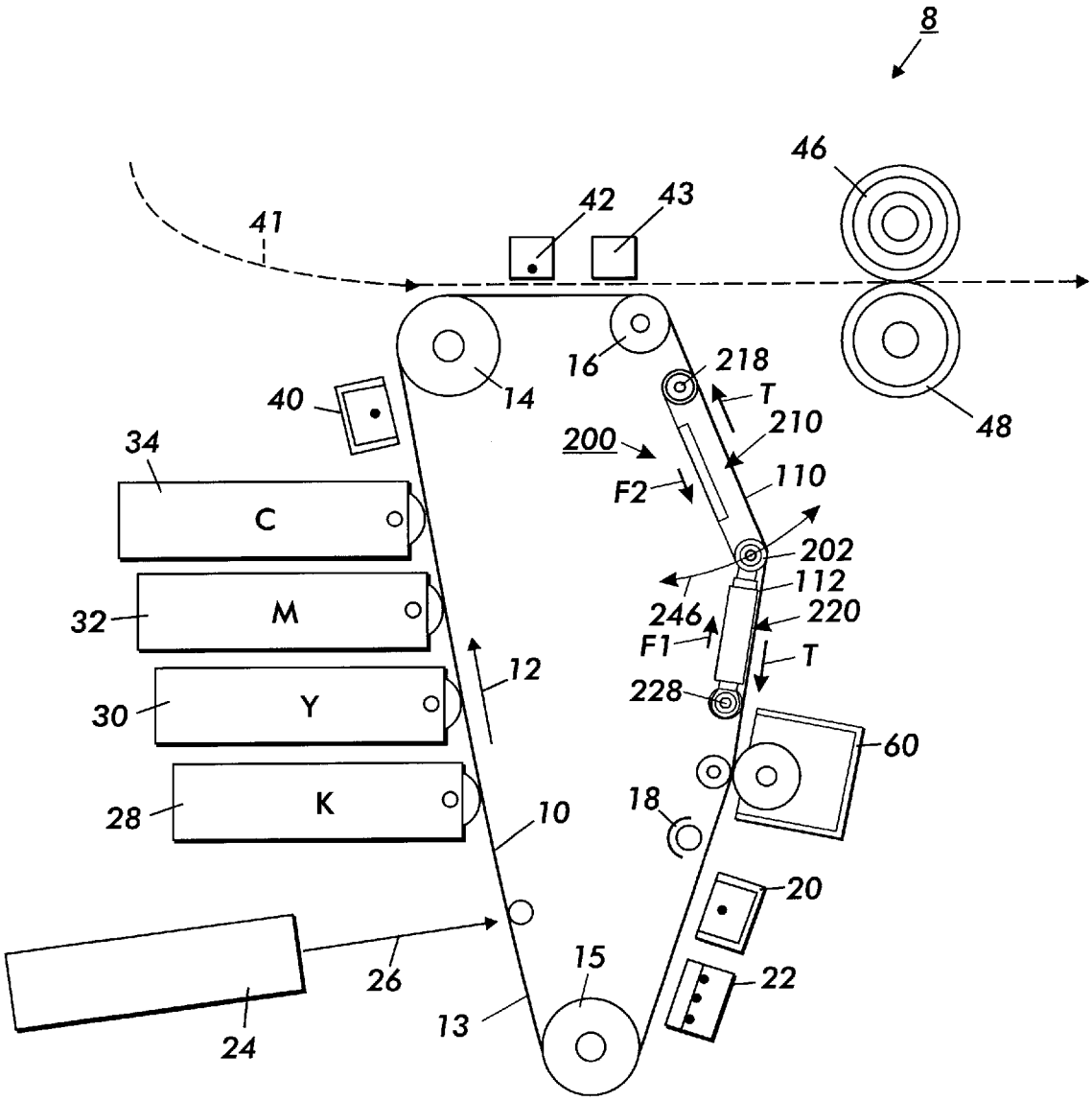
FIG. 2 is a vertical schematic of the exemplary electrostatographic reproduction machine of the present invention including the belt tension variation minimizing mechanism of the present invention.
Figure 3:
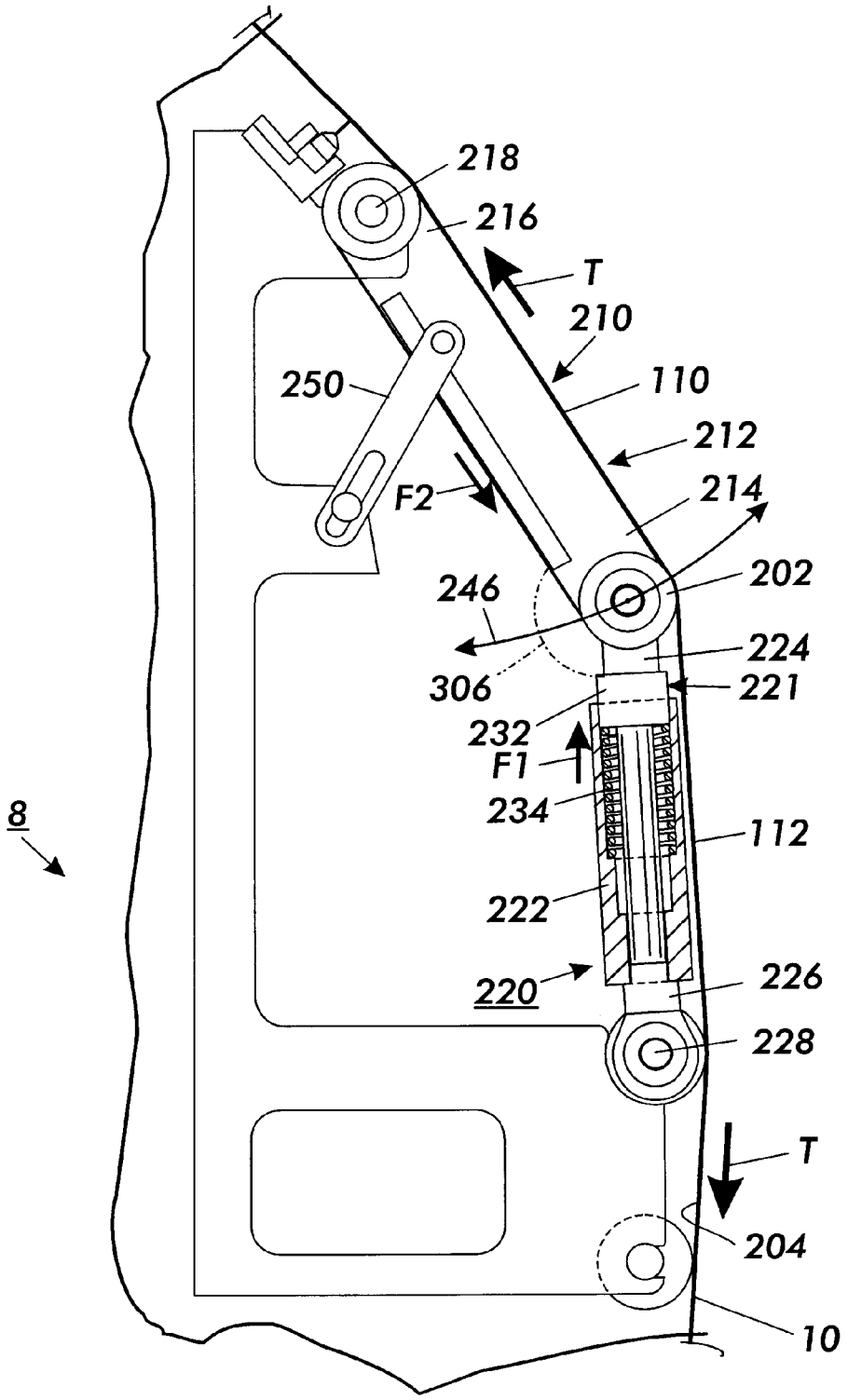
FIG. 3 is an enlarged illustration of a portion of the photoreceptor belt of the machine of FIG. 2 including the belt tension variation minimizing mechanism of the present invention in an on and belt tensioning position.

Referring first to FIGS. 1 and 2, a prior art or conventional exemplary electrostatographic reproduction machine, having a conventional tensioning roller 102, is shown generally in FIG. 1 as 6, and the electrostatographic reproduction machine of the present invention, having the belt tension minimizing mechanism 200 of the present invention, is shown generally in FIG. 2 as 8. Both reproduction machines however have like-frame and like-imaging components as will be clear from the following description where like numerals refer to like components. Each machine 6, 8, includes a photoconductive member shown in the form of an endless belt 10 that is moved in the direction of arrow 12, and is supported driveably about a series of rollers 14, 15 and 16 for example. As illustrated, the belt 10 forms a loop 13 about the series of rollers, and the roller 14 or 15 for example can be a drive roller for moving the belt 10 in the direction 12.

As shown, many electrostatographic elements (to be described below) are disposed around the loop 13 of belt 10, and can include imagers, ion generating devices for charging and discharging, cleaning blades and image transfer (or transfix) stations. In order to produce quality reproductions, these electrostatographic elements require that the loop 13 of the belt 10 have and maintain a desired tension setting. Unfortunate, in operation, these electrostatographic elements induce drag in the loop 13, and thus tend to alter or cause variation from the desired tension setting of the loop 13. Although not shown, many of these elements are complemented by backer bars or rollers on the inside of the belt loop in order to hold the belt at a precise and fixed distance from an active element such as a developer or an imaging device. Such backer bars, cleaning stations and imager transfer stations also each produce tension varying drag forces on the loop 13 of belt 10 as it is being driven about the series of support rollers.

Referring still to FIGS. 1 and 2, the exemplary reproduction machine 6, 8 is, for example only, one in which the photoreceptor 10 is erased between the development of black toner and the recharging of the photoreceptor for exposure of the next color image. As noted above, the machine 6, 8 includes a plurality of individual electrostatographic elements and subsystems which are known in the prior art, but which are organized and used, as here, so as to produce, for example, a color image in 4 passes, or cycles, of a photoreceptive member.

Specifically, the reproduction machine 6, 8 includes an Active Matrix (AMAT) photoreceptor belt 10 which travels in the direction indicated by the arrow 12. Belt 10 travel is brought about by mounting the photoreceptor belt about the drive roller 14 (that is driven by a motor which is not shown), and about other rollers including rollers 15 and 16. Further in accordance with the present invention, the belt 10 is mounted thus over a tensioning mechanism, namely a conventionally tensioning roller 102 (FIG. 1), and the belt tension variation minimizing mechanism 200 of the present invention (to be described in detail below).

As the photoreceptor belt 10 travels in the direction of the arrow 12, each part of it passes through each of the subsequently described process stations. For convenience, reference will be made to a single section of the photoreceptor belt constituting an image area. An image area as such is that part of the photoreceptor belt which is to receive the various toner layers which, after being transferred and fused to a substrate, produce the final color image. While the photoreceptor belt may have numerous image areas, since each image area is processed in the same way a description of the processing of one image area suffices to fully explain the operation of the reproduction machine.

As mentioned, the production of a color document on the machine 6, 8 for example, takes place in 4 cycles. The first cycle begins with the image area passing a "precharge" erase lamp 18 that illuminates the image area so as to cause any residual charge which might exist on the image area to be discharged. Such erase lamps are common in high quality systems and their use for initial erasure is well known.

As the photoreceptor belt continues its travel, the image area passes through a charging station consisting of an DC scorotron 20 and an AC scorotron 22. To charge the image area in preparation for exposure to create a latent image for black toner the DC scorotron charges the image area to a substantially uniform potential of, for example, about −500 volts. During this initial charging the AC scorotron 22 is not used. However, using both the DC scorotron 20 and the AC scorotron 22 will usually give better charge uniformity.

Next, the image area is advanced until it reaches an exposure station 24. At the exposure station the charged image area is exposed to a modulated laser beam 26 that raster scans the image area such that an electrostatic latent representation of a black image is produced. For example, illuminated sections of the image area might be discharged by the laser beam 26 to about −50 volts. Thus after exposure the image area has a voltage profile comprised of relatively high voltage areas of about −500 volts and of relatively low voltage areas of about −50 volts.

The exposed image area then passes a black development station 28 which deposits negatively charged black toner particles onto the image area. The charged black toner adheres to the illuminated areas of the image area thereby causing the voltage of the illuminated parts of the image area to be about −200 volts. The non-illuminated parts of the image area remain at −500 volts. The image area is then advanced past a number of other stations whose purposes are described subsequently and returns to the precharge erase lamp 18. The second cycle then begins.

The DC scorotron 20 performs the DC recharge by exposing the photoreceptor belt 10 so as to reduce the charge on the unexposed areas of the image area prior to recharging.

In the machine 6, 8 this is done by using the precharge erase lamp 18 to expose the image area. Therefore, as the image area advances past the precharge erase lamp 18, that lamp is illuminated. Thus after passing the precharge erase lamp 18, the DC scorotron 20 then recharges the image area to the charge level desired for exposure and for development of the yellow image. Here, the AC scorotron 22 is not used. The recharged image area with its black toner layer then advances to the exposure station 24. That exposure station exposes the image area with the laser beam 26 so as to produce an electrostatic latent representation of a yellow image.

The now exposed image area is then advanced past a yellow development station 30 that deposits yellow toner onto the image area. Since the image area already has a black toner layer, the yellow development station should use a scavengeless developer.

After the yellow development station 30, the image area and its two toner layers are advanced past the precharge exposure lamp 18, which is not illuminated, and then to the charging stations 20, 22 to begin the third cycle.

During the third and fourth cycles the charging stations 20, 22 use split recharging. Split recharging is particularly useful when overlaying one toner layer on another. Since black toner is not overlaid with other toner (the color would remain black and would be a waste of toner) their is little advantage to split recharging between the development of black and yellow toner layers. In split recharging the DC scorotron 20 overcharges the image area and its toner layers to a more negative potential than that which the image area and its toner layers are to have when they are next exposed.

After passing the AC scorotron 22, the substantially uniformly charged image area with its two toner layers advances once again to the exposure station 24. The exposure station again exposes the image area to the laser beam 26, this time with a light representation that discharges some parts of the image area to create an electrostatic latent representation of a magenta image.

The image area is then advanced through a magenta development station 32. The magenta development station, preferably a scavengeless developer, advances magenta toner onto the image area. The result is a third toner layer on the image area.

The image area with its three toner layers are then advanced past the precharge erase lamp 18 to the charging station. During this pass the precharge erase lamp 18 is not on. The fourth cycle then begins.

At the charging station, the DC scorotron 20 and the AC scorotron 22 again split recharge the image area (which now has three toner layers) to produce the desired charge on the photoreceptor. The substantially uniformly charged image area with its three toner layers then advances once again to the exposure station 24. The exposure station exposes the image area again, this time with a light representation that discharges some parts of the image area to create an electrostatic latent representation of a cyan image. After passing the exposure station the image area passes a cyan development station 34. The cyan development station, also a scavengeless developer, advances cyan toner onto the image area.

After passing the cyan development station the image area has four toner layers which together make up a composite color toner image. That composite color toner image is comprised of individual toner particles which have charge potentials which vary widely. Indeed, some of those particles take a positive charge. Transferring such a composite toner image onto a substrate would result in a degraded final image. Therefore it is beneficial to prepare the composite color toner image for transfer.

To prepare for transfer a precharge erase lamp 18 discharges the image area to produce a relatively low charge level on the photoreceptor. The image area then passes a pretransfer DC scorotron 40 which performs a pre-transfer charging function by supplying sufficient negative ions to the image area such that substantially all of the previously positively charged toner particles are reversed in polarity.

The image area continues to advance in the direction 12 past the drive roller 14. A substrate 41 is then placed in time registration over the image area using a sheet feeder (which is not shown). As the image area and substrate continue their travel they pass a transfer corotron 42. That corotron applies positive ions onto the back of the substrate 41 for attracting the negatively charged toner particles onto the substrate.

The substrate 41 then passes under a detack corotron 43 that neutralizes some of the charge on the substrate to assist separation of the substrate from the photoreceptor belt 10. As the lip of the substrate moves around the support roller 16, it separates from the photoreceptor belt 10, and is then directed into a fuser where a heated fuser roller 46 and a pressure roller 48 create a fusing nip through which substrate 41 passes. The combination of pressure and heat at the nip causes the composite color toner image to fuse into the substrate. After fusing, a chute, not shown, guides the substrate to a catch tray for example, also not shown, for removal by an operator.

After the substrate 41 is separated as above from the photoreceptor belt 10, the image area continues its travel and may pass a preclean erase lamp (not shown) that neutralizes most of the charge remaining on the photoreceptor belt, thus allowing residual toner and/or debris on the photoreceptor to be removed easily at a cleaning station 60. At the cleaning station 60, cleaning blades wipe residual toner particles from the image area, thus marking the end of the 4th cycle. The image area then passes once again to the precharge erase lamp 18 and the start of another 4 cycles.

In operation, the drive roller such as 14 pulls a portion of belt 10 (pulled portion) that is upstream of such roller 14, starting from the tensioning mechanism such as the conventional tensioning roller 102 of FIG. 1, or the belt tension minimizing mechanism 200 of the present invention. The drive roller 14 then pushes the other portion of belt 10 that is downstream of such roller 14 and ending at the tensioning mechanism 100, 200. The tension increases from the tensioning mechanism 100, 200 to the drive roller 14 in the pulled belt portion, and decreases from the drive roller 14 to the tensioning mechanism 100, 200. It is desirable that the tension difference at the drive roller 14 is sufficiently low so as not to induce slip in the loop 13 of belt 10 as it is being driven. The tension in the loop 13 of belt 10 must also be sufficiently high everywhere else in order to overcome the local drag forces of the backer bars and machine subsystems without causing slack or zero tension.

These requirements set a relatively narrow limit for controlling variations in belt tension at the tensioning mechanism. It has been found that the drag forces caused by the backer bars are proportionate to the belt tension, but that drag forces produced by machine subsystems and other elements (e.g., acoustic transfer assist devices) are independent of belt tension. Thus, higher tension conventionally helps the driving capability since the available tension difference at the drive roller increases with mean tension.

On the other hand, excessive tension may adversely affect the ability of a motor to drive the drive roller 14 and the belt 10, as well as the life of the photoconductive layer of the belt 10. Likewise, relatively high tension variations will cause relatively large variations in the state of elastic stretch of the belt 10, thus leading to errors in the relative registration of the various color separation toner images as formed above. These concerns thus require and establish an upper limit on belt tension and variations in such tension. There is therefore an optimal range for the belt tension and variations therein, and in many cases it can be quite narrow.

It should be noted that ordinarily, the manufacture of any endless belt such as the belt 10 results in some tolerance in its length. Ordinarily too, the length of the belt 10 further changes due to creep over its time of operation. Therefore, in order to accommodate these static changes in belt length, the tensioning mechanism such as the conventional tensioning roller 102, or the belt tension variation minimizing mechanism 200 of the present invention, must move to maintain belt tension. However, such movement ideally should also maintain and minimize any variation in the belt tension.

In addition to the static changes as above that affect belt length and hence belt tension, there are also dynamic changes that also affect belt tension. This is because all rollers (14, 15, 16 e.g.) within the belt loop 13 are likely to have some significant eccentricity. These eccentricities cause dynamic changes in the loop length that must be accommodated by movement in the tensioning mechanism 100, 200. These dynamic changes result in undesirable changes in belt tension. One undesirable consequence of such changes is variation of strain (elongation) imposed on the belt which causes errors in image to image as well as paper to image registration.

With reference now to prior art FIG. 1, conventional tensioning mechanisms for example use a tensioning roller 102 to apply a force F in the direction of the bisectrix to the angle 106 of wrap of the belt 10 over the roller 102. The force is conventionally applied by a compressed loading spring 114. Variations from a desired tension setting are ordinarily caused by movement of the tensioning roller 102 due to two problems, namely: (a) the finite stiffness of the loading spring 114, and (b) changes in the wrap angle 106 of the belt over the tensioning roller 102.

For symmetric configurations, where the outward force is F, the belt tension T in the spans 110, 112 adjacent to and on either side of the tensioning roller 102, can be expressed as: $T=F/[2 \sin (\gamma/2]$, where $\gamma$ is the wrap angle 106 of the belt 10 over the tensioning roller 102.

From this expression, and assuming a small wrap angle 106, it is possible to derive the sensitivity of the tension T on the belt 10 given variations in the initial length L of the spans. Such sensitivity of the tension to changes in the length L can be expressed as $(\Delta T)=-k/(L\gamma^2)$, where $-k$ is the spring stiffness constant, and L is the length of the two spans 110, 112 of the belt 10 adjacent the tensioning roller 102.

It can be seen from this expression that, for relatively small angles of wrap, the tension T will vary very rapidly. For a numerical example, let us use L=300 mm, $(\Delta L)$=1 mm, y=19.1 degrees, and k=4. From these values, the tension T of the belt 10 is found to vary by as much as 12% for such a small, 1 mm change in the length L.

Referring now to FIGS. 2–5, the belt tension variation minimizing mechanism 200 of the present invention and its operation within the electrostatographic reproduction machine 8, are illustrated in greater detail. As shown, the belt tension variation minimizing mechanism 200 comprises a moveable member 202 for mounting transversely to the direction 12 of movement of the moveable endless belt 10, and into contact with an inner surface 204 of the moveable endless belt 10. The belt tension variation minimizing mechanism 200 also comprises a first assembly 210 that includes at least a first rotatable arm 212 having a first end 214 connected to the moveable member 202, and a second end 216 coupled to a first pivot 218.

As shown, the belt tension variation minimizing mechanism 200 further comprises a second assembly 220 including at least a second rotatable arm 222 having a tensioning force applying means 221, and a first end 224 connected to the moveable member 202. The second rotatable member 222 also has a second end 226 coupled to a second pivot 228, and forms a lap angle 306 with the first rotatable arm 202. The tensioning force applying means 221 as mounted within the second rotatable arm 222, applies a tensioning force to the moveable member 202 such that the force has a direction which is non-orthogonal (that is, which is not perpendicular or normal) relative to the direction of movement 12 of the moveable endless belt 10 over the moveable member 202.

Figure 5:
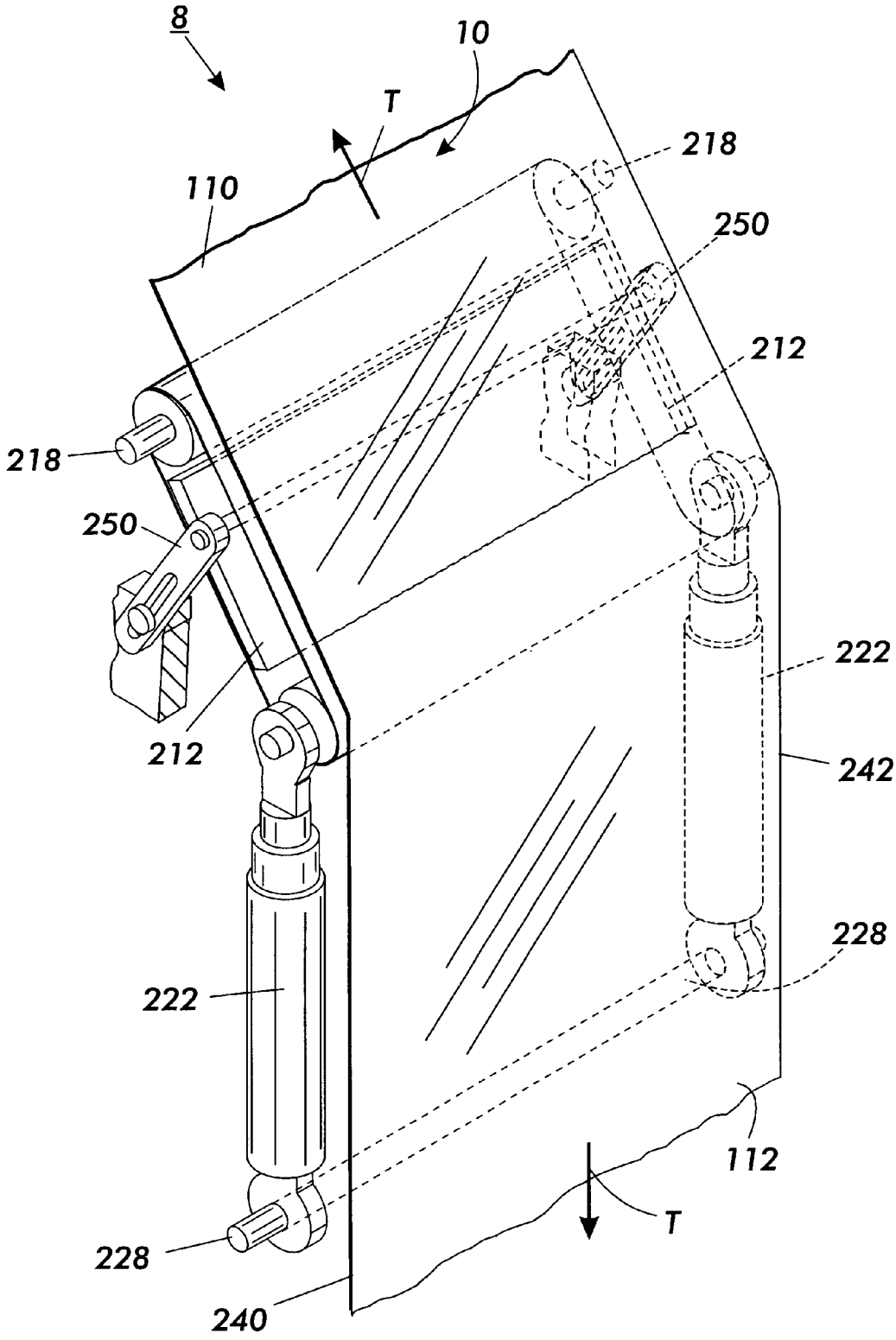
FIG. 5 is an enlarged illustration of the photoreceptor belt of the machine of FIG. 2 including the belt tension variation minimizing mechanism of the present invention.

As shown clearly in FIG. 5, in the belt tension variation minimizing mechanism 200 the first assembly 210 includes two first rotatable arms 212 each having a first end 214 thereof connected to the moveable member 202, and the second assembly 220 includes two second rotatable arms 222 each having a first end 224 thereof connected to the moveable member 202.

The moveable member 202 has a convex surface for forming the wrap angle (that is equal to the lap angle 306) with an inner surface 204 of the moveable endless belt 10. The wrap angle as shown is less than 180°. In order to minimize the drag force effect of the convex surface on the belt 10, the convex surface is preferably that of a roller as shown.

The tensioning force applying means 221 for example includes a telescoping member 232 and a compressed spring 234. As mounted, the tensioning force applying means 221 applies a tensioning and tensioning maintenance force F1 that is parallel to the direction of movement 12 of the moveable endless belt 10 between the moveable member 202 and the second pivot 228. In other words, the force F1 is applied in a direction that is parallel to the span 112 of the belt 10.

As shown in FIG. 5, one of the at least two first rotatable arms 212 is mounted to the moveable member 202 so as to be at a first edge 240 and at a second edge 242 of the moveable endless belt 10. Symmetrically, one of the at least two second rotatable arms 222 is mounted to the moveable member 202 so as also to be at the first edge 240 and at the second edge 242 of the moveable endless belt. As such, each of the at least two second rotatable arms 222 as shown is mounted at a common point to the moveable member 202 as one of the at least first rotatable arms 212.

Still referring to FIGS. 2–5, each of the two second rotatable (lower) arms 222 (one per side) is designed so as to capture and include the telescoping member 232 and the compressed spring 234. These arms 222 are attached to the moveable member 202 shown as a tension force applying roller and, thus through the moveable member or roller 202, each of these arms 222 push against each of the (upper) first rotatable arms 212 with a force F1, and each of the arms 212 push back with a force F2. The design and assembly are such that the forces F1, F2 in the two sets of arms, 212, 222 are equal in magnitude, and act, along the respective line of centers of the arms between their respective pivots 218, 228, on the moveable member or roller 202.

As pointed out above, the design is also such that the line of action of each of the forces, F1, F2 is parallel to the belt spans, 112, 110 respectively on either side of the moveable member or tension force applying roller 202. Therefore, the tension in the belt 10 is identical to the force in the arms. Thus, when the belt 10 changes length, the moveable member or tension force applying roller 202 moves in or out along a curved path 246 as shown on FIG. 2. Throughout each such movement, the lines of action of the forces F1, F2 in the arms 222, 212 respectively remain parallel to the belt spans 112, 110.

As a consequence, and in accordance with the present invention, whenever there is a change in the length of the endless belt 10, there is advantageously only a slight change in the compression of the spring 234. Additionally, this slight change in the compression of the spring 234 is the only change that affects the belt tension from its desired setting, thus minimizing variation or such change from the desired tension setting of the belt 10.

The spring 234 is preferably made as long as possible in order to minimize the force variation that can be induced by its finite stiffness. The relation between the change in tension $\Delta T$ and the change in belt length $\Delta L$ can as above be expressed as $\Delta T=-k\,\Delta L$, where k is the spring stiffness of the compressed spring. In a spring that has been compressed from an initial length of $S_0$ to S, and, in that state develops the tension T, the stiffness can be expressed as $k=T/[S\ \mathrm{In}(S_0/S)]$.

To verify and compare this with conventional tensioning mechanisms by using the same values as above, if the total length L of the two belt spans is: L=300 mm (i.e. 150 mm in length each), it is possible to design a spring that has a compressed length of S=100 mm. Assuming that the spring is compressed to half its initial length, the stiffness k can be computed as, $K=T/[100\ \ln(2)]=0.0144$ T/mm. Accordingly, the tension T will vary only by 1.4% per (mm) millimeter of belt length change, ($\Delta L$). The 1.4% variation is clearly only about one tenth of the 12% variation that was found in the case for the conventional mechanism using the same values. Advantageously therefore, the belt tension variation minimizing mechanism 200 of the present invention functions to provide a tensioning force that has small variations in magnitude as a function of static and dynamic changes in the length of the belt. This is accomplished by having the tensioning spring follow the motions of the belt so that the variations of the tensioning geometry do not cause force changes.

Figure 4:
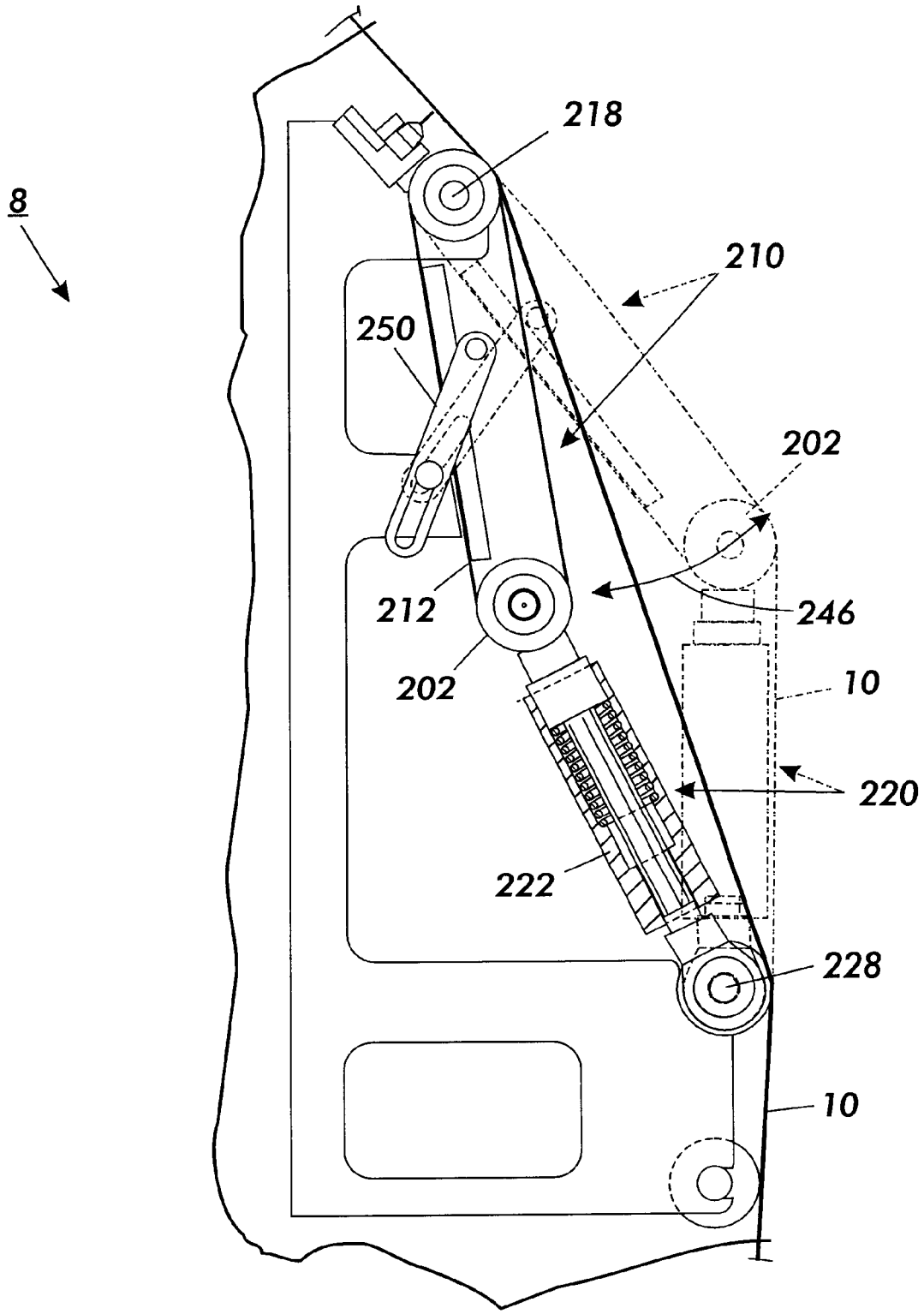
FIG. 4 is similar to FIG. 3 but with the belt tension variation minimizing mechanism of the present invention in an off and belt removing position in accordance with the present invention.

To enhance operability, the belt tension variation minimizing mechanism 200 of the present invention as shown in FIG. 4 includes a slidable and lockable link 250 that operates to limit the outward travel of the arms 212, 222 in the absence of an installed belt 10. This link 250 can also be used to lock the arms 212, 222 in a non-tensioning position as shown, for example, when it is desirable to change or replace the belt 10. As a further feature, the arms 212, 222 as mounted on each of the two edges 240, 242 of the belt 10 can be linked through the pivots 218, 228 so that the tension force applying roller 202 can only move parallel to itself.

As can be seen, there has been provided a tensioning mechanism for minimizing tension variations in a moveable endless belt having a desired tension setting and includes a moveable member for mounting transversely to a direction of movement of the moveable endless belt and into contact with the moveable endless belt; a first assembly including a first rotatable arm having a first end connected to the moveable member, and a second end coupled to a first pivot; and a second assembly including a tensioning force applying roller, and a second rotatable arm having a first end connected to the moveable member and a second end coupled to a second pivot. The second rotatable arm forms a lap angle with the first rotatable arm, and the tensioning force applying roller applies a tensioning force to the moveable member having a force direction that is non-orthogonal relative to the direction of movement of the moveable endless belt, thereby tensioning the moveable endless belt and minimizing variations from the desired tension setting of the moveable endless belt.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed:

1. A tensioning mechanism for minimizing tension variations in a moveable endless belt having a desired tension setting, the tensioning mechanism comprising:

(a) a moveable member for mounting transversely to a direction of movement of the moveable endless belt and into contact with the moveable endless belt;

(b) a first assembly including a first rotatable arm having a first end connected to said moveable member, and a second end coupled to a first pivot; and (c) a second assembly including a tensioning force applying means, and a second rotatable arm having a first end connected to said moveable member and a second end coupled to a second pivot, said second rotatable arm forming a lap angle with said first rotatable arm, and said tensioning force applying means applying a tensioning force to said moveable member having a force direction that is non-orthogonal relative to the direction of movement of the moveable endless belt, thereby tensioning the moveable endless belt and minimizing variations from the desired tension setting of the moveable endless belt.

2. The tensioning mechanism of claim 1, wherein said moveable member has a convex surface for forming a wrap angle with an inner surface of the moveable endless belt.

3. The tensioning mechanism of claim 1, wherein said tensioning force applying means includes a compressable spring.

4. The tensioning mechanism of claim 1, wherein said tensioning force applying means includes a telescoping member.

5. The tensioning mechanism of claim 1, wherein said force direction is parallel to a direction of movement of the moveable endless belt between said moveable member and said second pivot.

6. The tensioning mechanism of claim 1, wherein said lap angle is less than 180°.

7. A tensioning mechanism for minimizing tension variations in a moveable endless belt having a first edge, a second edge, and a desired tension setting, the tensioning mechanism comprising:

(a) a moveable member for mounting transversely to a direction of movement of the moveable endless belt and into contact with the moveable endless belt;

(b) a first assembly including at least two first rotatable arms each having a first end connected to said moveable member, and a second end coupled to a first pivot; and (c) a second assembly including at least two second rotatable arms each having a first end connected to said moveable member and a second end coupled to a second pivot, each arm of said at least two second rotatable arms including a tensioning force applying means and forming a lap angle with one of said at least two first rotatable arms, and said tensioning force applying means of each of said at least two first and second rotatable arms applying a tensioning force to said moveable member having a force direction that is non-orthogonal relative to the direction of movement of the moveable endless belt, thereby tensioning the moveable endless belt.

8. The tensioning mechanism of claim 7, wherein one of said at least two first rotatable arms is mounted to said moveable member so as to be at the first edge and at the second edge of the moveable endless belt.

9. The tensioning mechanism of claim 7, wherein one of said at least two second rotatable arms is mounted to said moveable member so as to be at the first edge and at the second edge of the moveable endless belt.

10. The tensioning mechanism of claim 7, wherein each of said at least two second rotatable arms is mounted at a common point to said moveable member as one of said at least first rotatable arms.

11. The tensioning mechanism of claim 7, wherein said moveable member has a convex surface for forcing a wrap angle with an inner surface of the moveable endless belt.

12. The tensioning mechanism of claim 11, wherein said moveable member is a roller.

13. The tensioning mechanism of claim 7, wherein said tensioning force applying means includes a compressable spring.

14. An electrostatographic reproduction machine comprising:

(a) electrostatographic imaging means, including a moveable endless belt having a desired tension setting, for forming and transferring a toner image onto a copy sheet;

(b) a fusing apparatus including a heated fusing member for heating and fusing the toner image onto the copy sheet; and (c) a tensioning mechanism for minimizing tension variations in the moveable endless belt, the tensioning mechanism including:

(i) a moveable member for mounting transversely to a direction of movement of the moveable endless belt and into contact with the moveable endless belt;

(ii) a first assembly including a first rotatable arm having a first end connected to said moveable member, and a second end coupled to a first pivot; and (iii) a second assembly including a tensioning force applying means, and a second rotatable arm having a first end connected to said moveable member and a second end coupled to a second pivot, said second rotatable arm forming a lap angle with said first rotatable arm, and said tensioning force applying means applying a tensioning force to said moveable member having a force direction that is non-orthogonal relative to the direction of movement of the moveable endless belt, thereby tensioning the moveable endless belt and minimizing variations from the desired tension setting of the moveable endless belt.

15. The electrostatographic reproduction machine of claim 14, wherein said moveable endless belt having a desired tension setting is a photoreceptor belt.

* * * * *